US006125910A

United States Patent [19]

Pepperell et al.

[11] Patent Number: 6,125,910

[45] Date of Patent: Oct. 3, 2000

[54] INTRUDER RESISTANT SCREEN

[76] Inventors: John Charles Pepperell, 322 Springwood Road, Springwood, Queensland 4127; Normal Cecil Waterman, 3 Waldorf Place, Runcorn, Queensland 4113, both of Australia

[21] Appl. No.: 09/169,702

[22] Filed: Oct. 9, 1998

Related U.S. Application Data

[63] Continuation-in-part of application No. 08/793,469, Feb. 26, 1997, abandoned.

[30] Foreign Application Priority Data

Aug. 30, 1994 [AU] Australia ..... 71528/94

[51] Int. Cl.[7] ..... A47G 5/00

[52] U.S. Cl. ..... 160/371; 160/380; 160/381; 160/395

[58] Field of Search ..... 160/371, 380, 160/381, 382, 390, 395, 399, 402

[56] References Cited

U.S. PATENT DOCUMENTS

| | | | |
|---|---|---|---|
| 1,350,027 | 8/1920 | Lane . | |
| 1,665,475 | 4/1928 | Plym . | |
| 1,811,553 | 6/1931 | McElyea . | |
| 1,826,606 | 10/1931 | Delaney . | |
| 1,830,945 | 11/1931 | Inglis . | |
| 1,842,575 | 1/1932 | Allsbury . | |
| 1,987,860 | 1/1935 | Milone | 156/14 |
| 2,042,726 | 6/1936 | Mueller | 156/14 |
| 2,314,026 | 3/1943 | Willett | 160/371 |
| 2,784,781 | 3/1957 | Rhoades | 160/371 |
| 2,784,782 | 3/1957 | Young | 160/395 |
| 2,989,788 | 6/1961 | Kessler | 20/56.1 |
| 4,341,255 | 7/1982 | Mock | 160/395 X |
| 4,453,585 | 6/1984 | Ruggeberg, Sr. et al. | 160/380 X |
| 4,566,236 | 1/1986 | Pound | 160/380 X |
| 4,665,670 | 5/1987 | Van Den Burg | 160/380 X |
| 4,932,457 | 6/1990 | Duncan | 160/380 |
| 5,040,456 | 8/1991 | Hayes | 160/381 X |
| 5,141,046 | 8/1992 | Duncan | 160/379 |
| 5,301,737 | 4/1994 | Martin | 160/380 |
| 5,502,906 | 4/1996 | Yamawaki | 160/381 X |
| 5,613,544 | 3/1997 | Schaefer | 160/371 X |
| 5,894,706 | 4/1999 | Herbst | 160/380 X |

FOREIGN PATENT DOCUMENTS

| | | | |
|---|---|---|---|
| 201741 | 12/1954 | Australia . | |
| 238859 | 5/1960 | Australia . | |
| 286318 | 10/1968 | Australia . | |
| 5885980 | 11/1981 | Australia | E06B 3/26 |
| 655152 | 10/1994 | Australia . | |
| 3610908 | 1/1987 | Germany | E06B 9/52 |

*Primary Examiner*—Bruce A. Lev
*Attorney, Agent, or Firm*—Rick Martin; Patent Law Offices of Rick Martin, P.C.

[57] ABSTRACT

An intruder resistant screen including a frame comprising elongate frame members each having a channel section engaging a respective corner stake in each end thereof. A woven wire intruder resistant mesh covering an opening enclosed by the frame. There are a plurality of clamping members that co-act with flanges projecting from the channel sections to provide leveraged clamping of the mesh against a clamping web. Respective fasteners fasten the clamping member to the clamping web.

23 Claims, 4 Drawing Sheets

INTRUDER RESISTANT SCREEN

This application is a continuation in part of application Ser. No. 08/793,469 filed on Feb. 26, 1997, now abandoned.

FIELD OF THE INVENTION

THIS INVENTION relates to an intruder resistant screen that provides both security against intrusion by undesirable persons (such as burglars and vandals) and insect screening of windows, doorways and the like.

BACKGROUND OF THE INVENTION

Screens or grilles are sometimes used to improve the security of a building. For example, steel bar grilles have been used to deter intruders from entering a premises through a window or door. When used for a window the steel bar grilles are bolted to a wall surface adjacent the window. When used for a doorway the steel bar grilles are pivotally mounted to the doorway and operate as an extra door.

Steel bar grilles are generally considered unsightly and are therefore usually only used for industrial buildings, shops and some places of business. Furthermore, the spacing between the steel bars of the grilles is usually wide enough to allow bolt cutters or hacksaws to cut the bars and therefore such grilles do not always provide adequate security.

An alternative to steel bar grilles are security screens which are often used to deter intruders from entering a premises through a window or door. Security screens comprise an extruded frame with a wide grate mesh covering the area enclosed by the extruded frame. The wide grate mesh typically has elongate members of 7 mm diameter with mesh gaps of approximately 60 mm. The mesh is normally fitted into a slot in the frame and is not usually clamped to the frame. One reason for this is because the wide grate mesh is usually made from expanded aluminium which is not suited to bolting due to the spaced small surface areas of the mesh which contact the frame. In addition, the contours of the mesh would require accurate and specific alignment of bolt holes for each screen which is labour intensive. Accordingly, it is possible for a potential intruder to remove the unbolted mesh partly or completely from the frame.

Such security screens also suffer from the same disadvantages as steel bar grilles in that the mesh can be cut by bolt cutters or hacksaws.

The above described screens or grilles can provide limited security even when their associated window or door is opened for ventilating a premises. However, these screens or grilles are not effective for insect screening and therefore fine mesh screens are sometimes used in conjunction with security screens or grilles for the purpose of insect screening. The fine mesh is usually either mounted to a wooden frame or mounted to a spline of the extruded frame of the screen in which a rubber strip is used to maintain edges of the mesh in the spline.

The above fine mesh screens are not intruder resistant as the wooden frame can be easily broken or the mesh can be easily removed from the spline. Furthermore, the fine mesh which is used is often made of thin nylon or thin metal strands which can be easily broken. Accordingly, to provide limited security and insect screening both fine mesh screens and security screens or grilles are often used which has the disadvantage of increased manufacturing or installation costs.

Examples of either security screens or insect screens can be found in the prior art. The prior art does not provide screens which are both insect screening and of sufficient strength to prevent entry by undesirable persons.

One prior art example is U.S. Pat. No. 1,588,161, in the name of Bost. Bost teaches a small metal frame that frictionally holds screen wire. The screen wire is held in a recess (or spline as described above) by a hard cord which is pressed into the recess. The screen wire must be malleable so that it can be easily deformed to line the recess and permit further deformation upon insertion of the cord. Bost also discloses a plate that covers the cord and recess to give the frame a suitable appearance.

Bost does not disclose a screen of sufficient strength to prevent entry by intruders nor a method of securing a suitable screen to the frame. A screen having sufficient strength to provide intruder resistance will not be malleable in the manner required to implement the cord and recess clamping arrangement of Bost.

A similar arrangement is disclosed in U.S. Pat. No. 3,220,469, in the name of Oehmig. Oehmig describes an improved screen in which the mesh is retained in a mounting pocket and a molding strip snaps over the mounting pocket to improve the appearance. Like Bost the screen is malleable to facilitate retention of the screen in the mounting pocket by a push-in bead. Oehmig also describes the option of incorporating the bead into the molding strip.

As with Bost, the clamping arrangement of Oehmig can not provide sufficient strength to hold a screen that will provide intruder resistance. Furthermore, a mesh sufficiently malleable to deform into the mounting pocket can not have sufficient strength to provide a barrier to entrance by burglars.

U.S. Pat. No. 5,141,046, in the name of Duncan, relates to the use of screens for security and/or to resist vandalism. Duncan acknowledges that a mesh having intruder resistant properties can not be deformed in the manner required for the conventional fastening methods described above. Duncan describes the use of a flat retainer bar that clamps the mesh to the frame and is fastened by two lines of screws. Although an improvement over the prior art, Duncan still fails to provide sufficient holding strength to retain the mesh in the frame when attacked by a determined intruder.

OBJECT OF THE INVENTION

It is an object of the invention to provide an intruder resistant screen which overcomes or at least alleviates at least one of the problems associated with prior art screening of doorways, windows or the like.

SUMMARY OF THE INVENTION

According to one aspect of the invention, there is provided an intruder resistant screen comprising:

- a frame formed from elongate frame members, each member including a wall section having a channel section formed towards one end thereof, a flange projecting from the channel section and a clamping web projecting from the wall section at a position distal from the flange;
- a substantially non-malleable, woven wire mesh covering an opening enclosed by said frame;
- a plurality of clamping members co-acting with the flange to provide leveraged clamping of the mesh between the clamping members and the clamping web; and
- fastening means fixing said clamping member to said clamping web.

The screen suitably further comprises corner stakes engaging each end of the channel sections for assembly of the frame members to form said frame.

In preference the mesh has spacings between adjacent wefts or warps of no greater than 2.2 mm Suitably, said spacings are in the range between 1 mm to 2.1 mm.

Suitably, said clamping members extend along the length of a respective frame member.

The woven wire is preferably stainless steel wire of a diameter between 0.5 mm to 1.2 mm. Suitably, the diameter may be between 0.8 mm to 1.2 mm.

The frame members may be extruded lengths, roll formed lengths or press formed.

Suitably, the frame members are extruded aluminium lengths.

Preferably, said channel section may be a closed channel section.

Suitably, said clamping web is located inwardly relative to said channel section.

Preferably, there is a lip section adjacent a free end of said wall section, wherein said lip section extends towards said mesh.

Suitably, said lip section may co-act with one of said clamping members to thereby clamp said mesh there between.

Suitably, an area adjacent each respective edge of said mesh is clamped to said frame such that each clamped area is in the same plane as said mesh enclosed by said frame.

Preferably, said flange section and said wall section provide a recess accommodating an edge of said clamping member.

Preferably, said screen has cover engagement means for allowing a cover strip to be mounted thereto and thereby concealing said fastening means when said screen is viewed from an inner side.

Suitably, said cover engagement means includes two parallel slots. Alternatively, said cover engagement means may be a channel in said frame member.

The fastening means may be rivets or screws. The screws may be self tapping or otherwise. Altematively, the fastening means may be snap fitments.

Suitably, said wall section conceals said fastening means when said screen is viewed from an outer side.

Preferably, said cover strip is mounted to said cover engagement means.

BRIEF DESCRIPTION OF THE DRAWINGS

In order that the invention may be readily understood and put into practical effect, reference will now be made to preferred embodiments in which.

DETAILED DESCRIPTION

Figure 1:
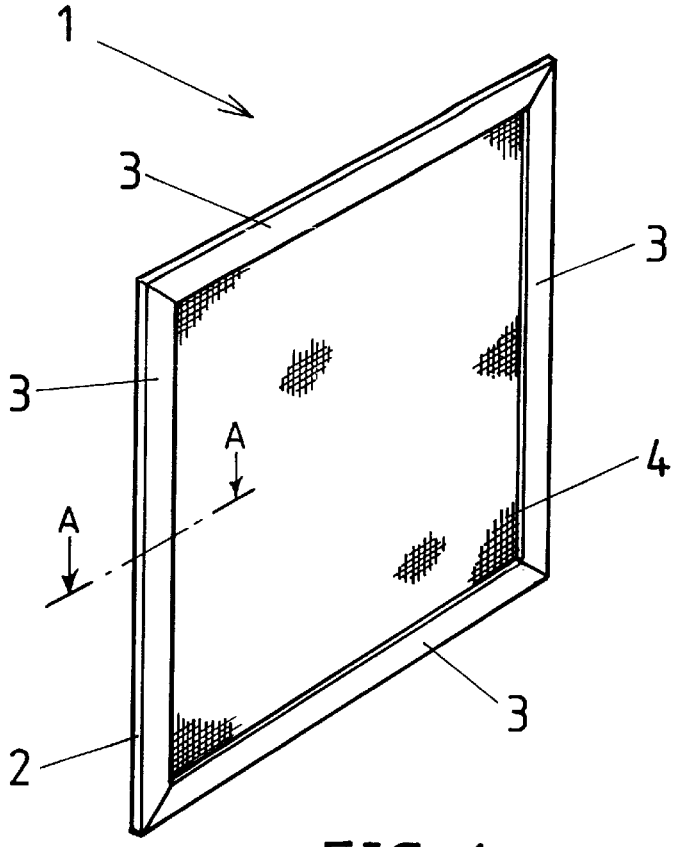
FIG. 1 is a perspective view of an intruder resistant screen.

With reference to FIG. 1 there is illustrated an intruder resistant screen 1 having a frame 2 comprised of elongate frame members 3 with an intruder resistant mesh 4 clamped to frame members 3. By intruder resistant mesh is meant a mesh that has sufficiently small spacings between wires to provide effective insect screening yet has sufficient strength to provide an effective barrier to entry by intruders, such as burglars and vandals.

Mesh 4 covers the opening enclosed by frame 2. Mesh 4 is a woven grid, of stainless steel wire which has dimensions selected from table 1 below.

Figure 2:
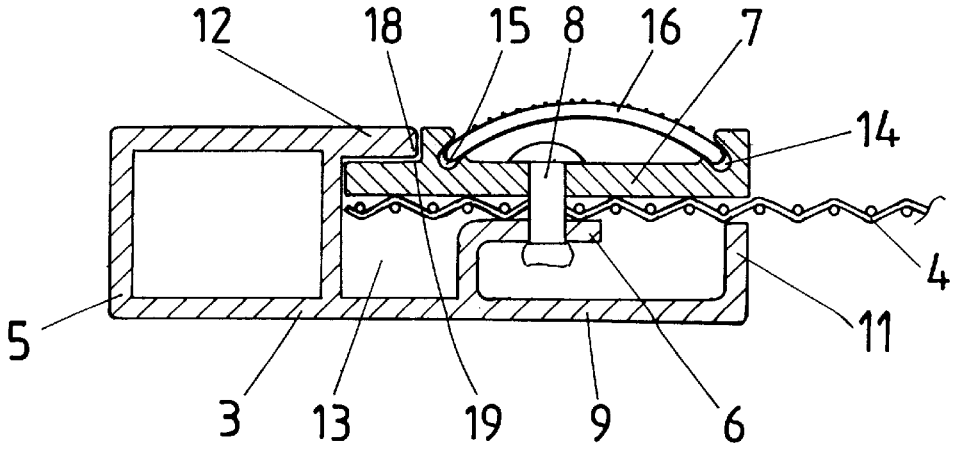
FIG. 2 is a cross sectional view through A—A of FIG. 1 illustrating a first embodiment of the invention.
Figure 3:
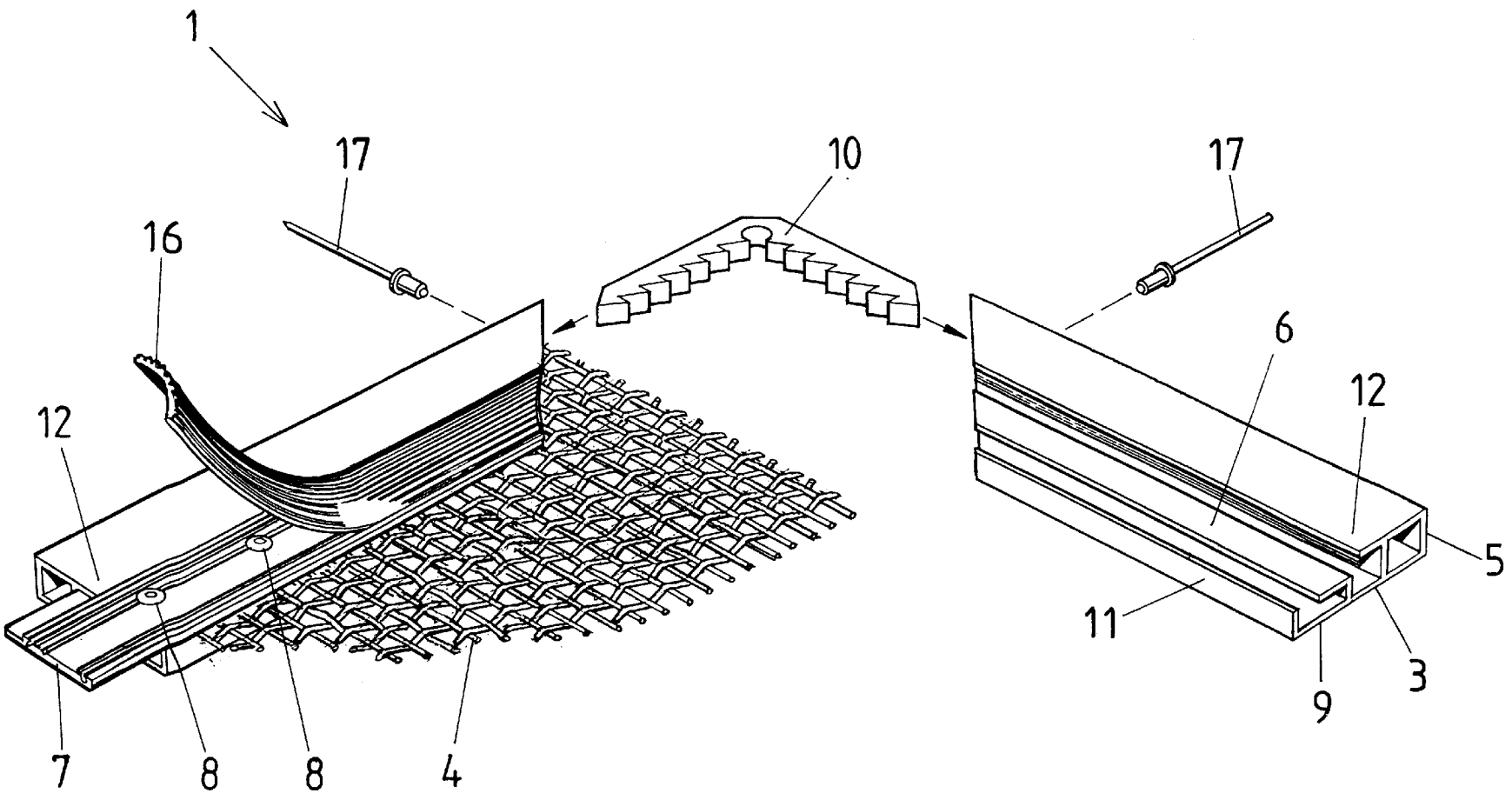
FIG. 3 is an exploded perspective view illustrating how frame members of FIG. 2 form a corner section.

Referring to FIG. 2 and FIG. 3, an embodiment of one of frame members 3 is illustrated. Frame member 3 is formed from extruded aluminium and has a wall section 9 that is presented to the outside of the opening being screened. A channel section 5 is formed towards one end of the wall section 9 for receiving a corner stake 10 at each of its ends. Accordingly, frame 2 is formed to a desired shape and dimensions by cutting suitable lengths of each frame member 3 and assembling the lengths with mitred corners.

Located inwardly of channel 5 is a clamping web 6 projecting from wall section 9. A flange 12 projects from the channel section 5 at a level just above the height of the clamping web 6. The distance between the plane of the top of the clamping web 6 and the plane of the flange 12 is just less than the combined thickness of the mesh 4 and clamping member 7. One end of clamping member 7 seats under flange 12 to provide a leveraged clamping of the mesh 4 between clamping member 7 and clamping web 6.

TABLE 1

| Number of Mesh Wires per 25 mm | Wire Diameter in mm | Mesh open area | weft/warp spacings in mm |
|---|---|---|---|
| 14 × 14 | 0.8 | 29.8% | 0.1 mm |
| 14 × 14 | 0.7 | 36.2% | 1.1 mm |
| 14 × 14 | 0.5 | 31.0% | 1.3 mm |
| 12 × 12 | 1.0 | 25.4% | 1.0 mm |
| 12 × 12 | 0.9 | 33.2% | 1.2 mm |
| 12 × 12 | 0.7 | 43.6% | 1.4 mm |
| 12 × 12 | 0.6 | 51.8% | 1.5 mm |
| 10 × 10 | 1.2 | 28.1% | 1.3 mm |
| 10 × 10 | 1.0 | 34.8% | 1.0 mm |
| 10 × 10 | 0.9 | 42.3% | 1.6 mm |
| 10 × 10 | 0.8 | 46.2% | 1.7 mm |
| 10 × 10 | 0.7 | 51.8% | 1.8 mm |
| 8 × 8 | 1.2 | 38.9% | 2.0 mm |
| 8 × 8 | 1.0 | 45.2% | 2.1 mm |
| 8 × 8 | 0.9 | 51.8% | 2.2 mm |

Because the space between the plane of the top of clamping web 6 and the plane of the flange 12 is slightly less than the combined thickness of the mesh 4 and clamping member 7, the clamping member 7 will initially sit at an angle such that the distal end is deflected away from the frame member 3. A pivot is formed between the end 18 of flange 12 and an intermediate point 19 on the clamping member 7.

Pressure is applied to the distal end of clamping member 7 causing pivoting at point 19 until the clamping member 7 firmly clamps the mesh 4 against the clamping web 6. Fastening means 8 are then applied to maintain the clamping member 7 in position.

Both clamping web 6 and clamping members 7 are of an identical length and extend along the length of frame member 3. Spaced holes are drilled along clamping web 6 and clamping member 7 to receive fastening means 8, shown as pop-rivets in FIG. 2. Other suitable fastening means, such as screws, bolts or snap fitments could also be employed.

Fastening means 8 co-act with clamping web 6 and clamping members 7 to clamp mesh 4 to frame 2. Hence, when clamped an area adjacent each respective edge of mesh 4 is clamped to frame 2 such that each clamped area is in the same plane as the rest of mesh 4 which is enclosed by frame 2. As a result each edge of mesh 4 is clamped to no more than one clamping surface of each one of clamping web 6 and clamping member 7. Said fastening means 8 equates to a fastener.

A recess 13 is formed by flange 12, channel section 5 and wall section 9. The recess 13 accommodates the edge of clamping member 7 and an edge of mesh 4 during assembly.

In the embodiment of FIG. 2, a lip section 11 at the free end of wall section 9 extends towards mesh 4 and co-acts with clamping member 7 to also clamp mesh 4. This provides additional security by reducing the possibility of an intruder forcing, for example, a lever between clamping web 6 and clamping member 7.

Clamping member 7 has two parallel slots 14, 15 for attaching a flexible covering strip 16 which therefore covers the heads of fastening means 8. The covering strip 16 improves the appearance of the screen.

As shown in FIG. 3 two frame members 3 are attached together at a corner of frame 2 by corner stake 10 being inserted into a channel section 5 of two mitred frame members 3. Holes are then drilled into edges of frame members 3 and corner stake 10. Pop-rivets 17 are then inserted for securing frame members 3 to corner stake 10.

Figure 4:
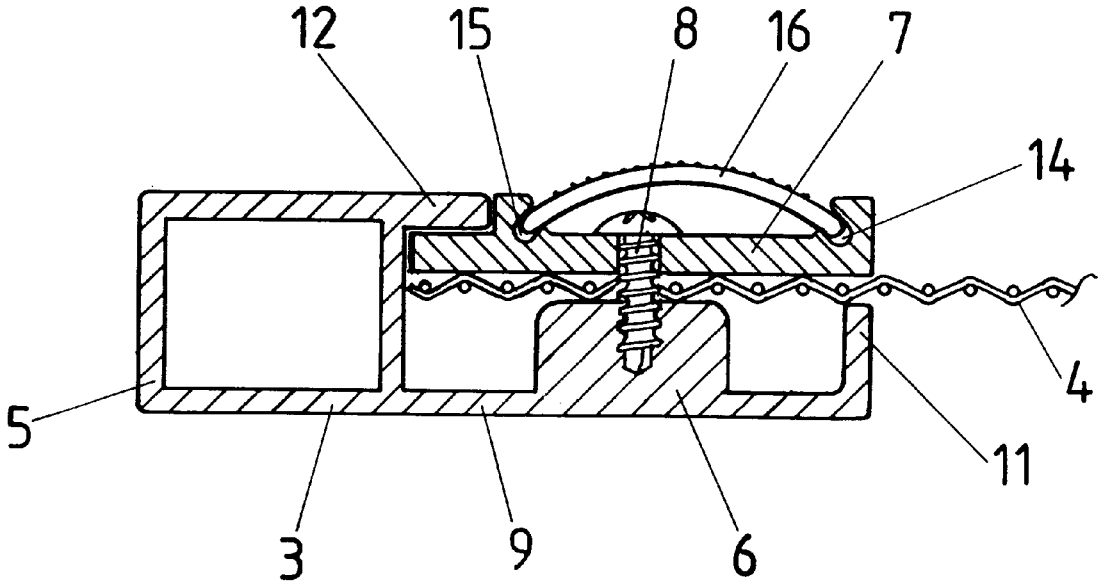
FIG. 4 is a cross sectional view through A—A of FIG. 1 illustrating a second embodiment of the invention.

Illustrated in FIG. 4 is a second embodiment of one of frame members 3. In this embodiment clamping web 6 is formed as a protrusion from wall section 9. Fastening means 8 are suitably self tapping screws. The advantage of this arrangement is that alignment of holes in clamping member 7 and clamping web 6 is not required as the self tapping screws can be driven directly into the web 6.

One possible failure mode of the security of the screen is that the mesh can pull from the frame if repeated pressure is applied to the middle of the mesh, causing it to deform and thereby pull away from the frame. The possibility of this failure mode is greatly reduced by the present invention due to the additional holding force achieved with the leveraged clamping of clamping member 7 against clamping web 6.

Figure 5:
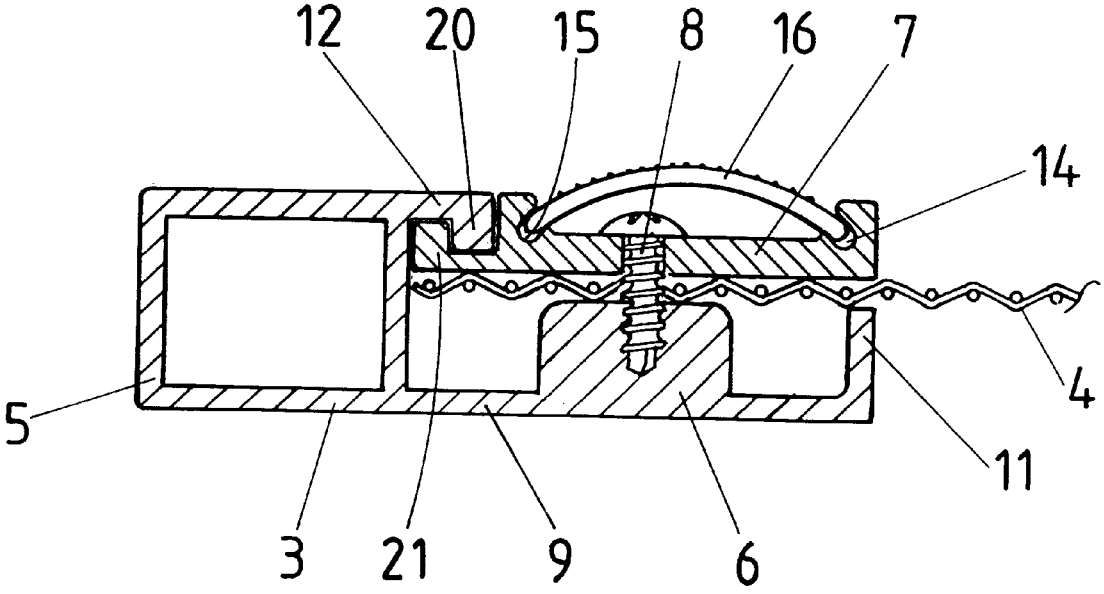
FIG. 5 is a cross sectional view through A—A of FIG. 1 illustrating a third embodiment of the invention.
Figure 6:
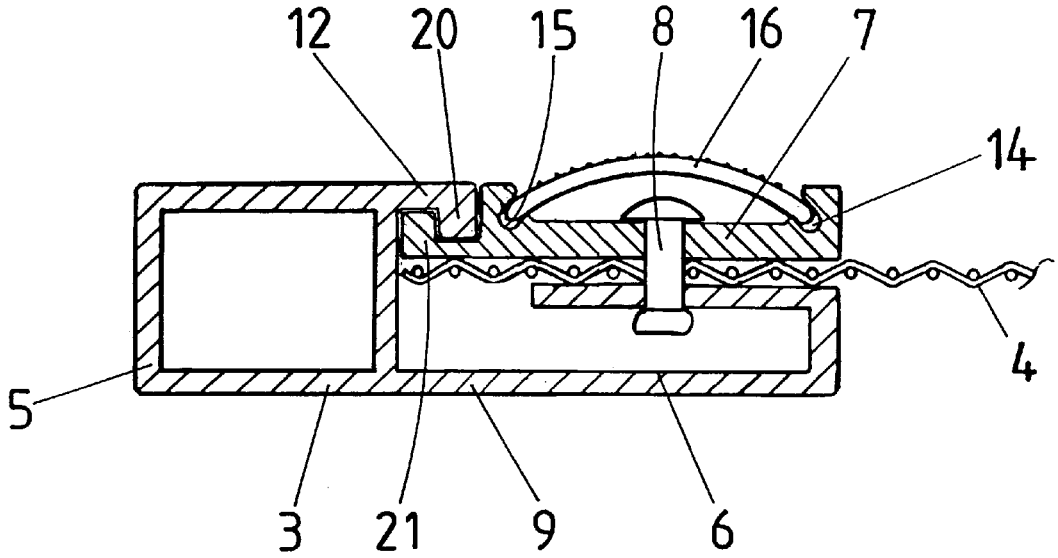
FIG. 6 is a cross sectional view through A—A of FIG. 1 illustrating a fourth embodiment of the invention.
Figure 7:
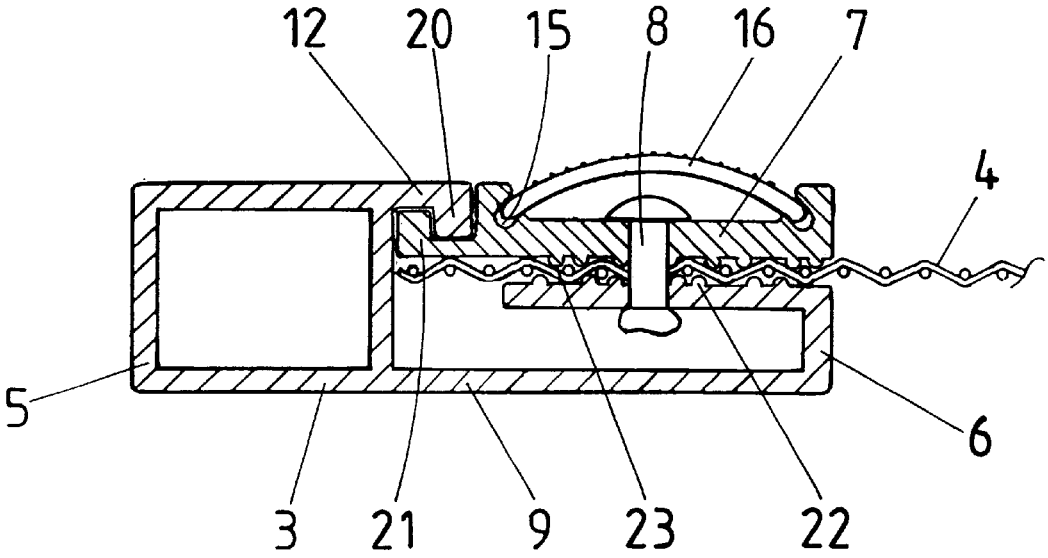
FIG. 7 is a cross sectional view through A—A of FIG. 1 illustrating a fifth embodiment of the invention.

Another possible failure mode is that sheering can occur at the fastening means 8 so that the clamping member 7 and the mesh 4 pull away from the frame 2, The inventors have found that this failure mode can be reduced or eliminated by the embodiments shown in FIGS. 5–7.

Referring to FIG. 5, a third embodiment of one of frame members 3 is illustrated. As with the previous embodiments, the frame member 3 consists of a wall section 9 that is presented to the outside of the opening being screened. A channel section 5 is formed towards one end of wall section 9. A flange 12 projects from the channel section 5 and one end of clamping member 7 positions under the flange 12 for leveraged clamping of mesh 4 against clamping web 6.

The embodiment of FIG. 5 differs from the embodiment of FIG. 4 by the provision of hook member 20 dependent from flange 12. Corresponding catch member 21 projects from clamping member 7. The hook member 20 and catch member 21 co-act to positively engage the clamping member 7 with the frame member 3. This positive engagement effectively minimises the possibility of the clamping member 7 pulling away from the frame member 3. Furthermore, the inventors have found that fewer fastening means 8 need be used with this embodiment to achieve equivalent security.

Illustrated in FIG. 6 is a fourth embodiment of one of frame members 3. In this embodiment lip section 11 of previous embodiments has been eliminated and the clamping web 6 moved to the end of the wall section 9.

A fifth embodiment of one of frame members 3 is shown in FIG. 7. The embodiment is equivalent to the embodiment of FIG. 6 with the addition of serrations 23 on the underside of clamping member 7 and corresponding serrations 22 on the top surface of clamping web 6.

Referring to FIG. 7 there is shown a frame member 3 consisting of a wall section 9. A channel section 5 is formed at one end of the wall section 9 and a clamping web 6 is formed at the other end of wall section 9. A top surface of clamping web 6 is provided with serrations or ridges that engage the mesh 4.

A clamping member 7 has a catch member 21 projecting from one end that engages a hook member 20 depending from flange 12 that projects from the channel section 5 The distance between the plane of the top surface of the clamping web 6 and the plane of the flange 12 is less than the combined thickness of the clamping member 7 and the mesh 4 so pressure must be applied to a distal end of the clamping member 7 in order to urge it towards the clamping web 6. The clamping member 7 and flange 12 co-act to provide leveraged clamping of the mesh 4. Fastening means 8 fasten the clamping member 7 to the clamping web 6.

The inventors have found that the combination of the leveraged clamping and the serrated surface of the clamping web, provide a very secure holding of the mesh 4. Furthermore, the positive engagement of the clamping member 7 to the frame member 3 further enhances the security of the screen.

It will be appreciated that the serrations or ridges could be applied to the underside of the clamping member 7, the top surface of clamping web 6, or both surfaces as shown in FIG. 7.

In use intruder resistant screen 1 may be mounted on hinges in a doorway or secured in any known manner to a window frame. Mesh 4 provides a barrier to intruders as a sufficiently large hole to gain entry cannot be easily sawn or cut by bolt cutters due to the mesh grade which also provides insect screening. Furthermore, when stainless steel mesh 4 is used these difficulties for potential intruders can be compounded due to the properties of stainless steel which can blunt cutting tools.

The clamping of the mesh provides additional intruder resistance in which wall sections 9 are located on the outside of the doorway or window so that for example rivets 8 are concealed from a potential intruder.

When viewed on the inside, rivets 8 are hidden by cover 16 which is of a colour matching clamping member 7.

Although the invention has been described with reference to preferred embodiments, it is to be understood that the invention is not limited to the specific embodiments described herein.

What is claimed is:

1. An intruder resistant screen including:

a frame formed from elongate extruded frame members, each member including a wall section having a channel section formed towards one end thereof; a flange projecting from the channel section and a clamping web projecting substantially perpendicular from the wall section at a position distal from the flange, said clamping web having a clamping surface substantially parallel to said wall section;

a planar non-malleable, woven wire mesh covering an opening enclosed by said frame;

a plurality of clamping members, each clamping member co-acting with the respective flange to provide leveraged clamping of the mesh between the clamping member and the clamping web; and a plurality of fasteners, passing through said wire mesh, fixing said clamping members to said clamping web.

2. The intruder resistant screen of claim 1, wherein said clamping members extend along the length of respective frame members.

3. The intruder resistant screen of claim 1 wherein the woven wire is stainless steel wire of a diameter between 0.5 mm to 1.2 mm.

4. The intruder resistant screen of claim 3 wherein the woven wire has a diameter between 0.8 mm to 1.2 mm.

5. The intruder resistant screen of claim 1 wherein spacings between adjacent wires are no greater than 2.2 mm.

6. The intruder resistant screen of claim 5 wherein said spacings are in the range between 1 mm to 2.1 mm.

7. The intruder resistant screen of claim 1 wherein the frame members are extruded aluminium lengths.

8. The intruder resistant screen of claim 1 further comprising a lip section adjacent a free end of said wall section, wherein said lip section extends towards said mesh.

9. The intruder resistant screen of claim 8 wherein said lip section co-acts with said clamping members to thereby clamp said mesh therebetween.

10. The intruder resistant screen of claim 1 wherein an area adjacent each respective edge of said mesh is clamped to said frame such that each clamped area is in the same plane as said mesh enclosed by said frame.

11. An intruder resistant screen as claimed in claim 1, wherein said flange and said wall section provide a recess accommodating an edge of said clamping members.

12. The intruder resistant screen of claim 1 further comprising cover engagement means mounting a cover strip for concealing said fastening means when said screen is viewed from an inner side.

13. The intruder resistant screen of claim 12 wherein said cover engagement means includes two parallel slots.

14. The intruder resistant screen of claim 12 wherein said cover engagement means is a channel in said frame member.

15. The intruder resistant screen of claim 1, wherein the fasteners are screws.

16. The intruder resistant screen of claim 1 wherein the fastening means are snap fitments.

17. The intruder resistant screen of claim 1 wherein said wall section conceals said fastening means when said screen is viewed from an outer side.

18. The intruder resistant screen of claim 1 further comprising a hook member associated with the flange of each said extruded frame member and corresponding catch members associated with the clamping members, said hook members and said catch members co-acting to engage said clamping members with said frame.

19. The intruder resistant screen of claim 1 further comprising mesh engaging serrations formed on a mesh contacting surface of the clamping web.

20. The intruder resistant screen of claim 1 further comprising mesh engaging serrations formed on a mesh contacting surface of the clamping member.

21. A intruder resistant screen comprising:

a frame formed from elongate frame members, each member including a wall section having a channel section formed towards one end thereof, a flange projecting from the channel section and a clamping web projecting substantially perpendicular from the wall section at a position distal from the flange, said clamping web having a clamping surface substantially parallel to said wall section;

a planar non-malleable, woven wire mesh covering an opening enclosed by said frame;

a plurality of clamping members, each clamping member co-acting with the respective flange to provide leveraged clamping of the mesh between the clamping member and the clamping web;

a plurality of fasteners, passing through said wire mesh, fixing said clamping members to said clamping web; and a clip mounting a cover strip for concealing said fastener when said screen is viewed from an inner side.

22. An intruder resistant screen including a frame formed from elongate extruded frame members, each member including a wall section having a channel section formed towards one end thereof, a flange projecting from the channel section and a clamping web projecting from the wall section at a position distal from the flange;

a planar non-malleable, woven wire mesh covering an opening enclosed by said frame;

a plurality of clamping members, each clamping member co-acting with the respective flange to provide leveraged clamping of the mesh between the clamping member and the clamping web;

a plurality of fasteners, fixing said clamping members to said clamping web; and a cover connector including two parallel slots for mounting a cover strip for concealing said fasteners when said screen is viewed from an inner side.

23. An intruder resistant screen including a frame formed from elongate extruded frame members, each member including a wall section having a channel section formed towards one end thereof, a flange projecting from the channel section and a clamping web projecting from the wall section at a position distal from the flange;

a planar non-malleable, woven wire mesh covering an opening enclosed by said frame;

a plurality of clamping members, each clamping member co-acting with the respective flange to provide leveraged clamping of the mesh between the clamping member and the clamping web;

a plurality of fastening means, fixing said clamping members to said clamping web; and a cover engagement means mounting a cover strip for concealing said fastening means when said screen is viewed from an inner side, wherein said cover engagement means is a channel in said frame member.

* * * * *